US005416952A

United States Patent [19]

Dodge

[11] Patent Number: 5,416,952

[45] Date of Patent: May 23, 1995

[54] RATCHET-TYPE BUCKLE

[75] Inventor: David J. Dodge, Shelburne, Vt.

[73] Assignee: Burton Snowboards, Burlington, Vt.

[21] Appl. No.: 188,553

[22] Filed: Jan. 27, 1994

[51] Int. Cl.[6] ..... A43C 11/00

[52] U.S. Cl. ..... 24/68 R; 24/68 A; 24/68 SK

[58] Field of Search ..... 24/68 R, 68 SK, 68 A, 24/69 ST, 69 SK, 70 SK, 71 SK; 36/50.1, 119

[56] References Cited

U.S. PATENT DOCUMENTS

| | | | |
|---|---|---|---|
| 3,662,435 | 5/1972 | Allsop | 24/70 SK |
| 4,193,171 | 3/1980 | Lichowsky | 24/68 SK |
| 4,326,320 | 4/1982 | Riedel | 24/70 SK |
| 4,453,290 | 6/1984 | Riedel | 24/68 SK |
| 4,547,980 | 10/1985 | Olivieri | 24/70 SK |
| 4,670,946 | 6/1987 | Olivieri | 24/68 A |
| 4,683,620 | 8/1987 | Valsecchi et al. | 24/68 SK |
| 4,796,337 | 1/1989 | Marxer | 24/68 SK |
| 5,083,350 | 1/1992 | Sandreid | 24/134 R |

*Primary Examiner*—Victor N. Sakran
*Attorney, Agent, or Firm*—Darby & Darby

[57] ABSTRACT

A snowboard ratchet-type buckling arrangement includes a housing and a strap slidably received within the housing. The strap has a rack of teeth on its upper surface. A tab is pivotally mounted to the housing about a first axis and is spring-biased into engagement with the rack of teeth on the strap. The tab allows the strap to move in a first direction and prevents movement of the strap in a second direction. A lever arm is pivotally mounted about the housing about the first axis and a second axis which is spaced from the first axis. When the lever arm is pivoted about the second axis, saw teeth engage the rack of teeth on the strap to incrementally ratchet the strap through the housing in the first direction.

20 Claims, 3 Drawing Sheets

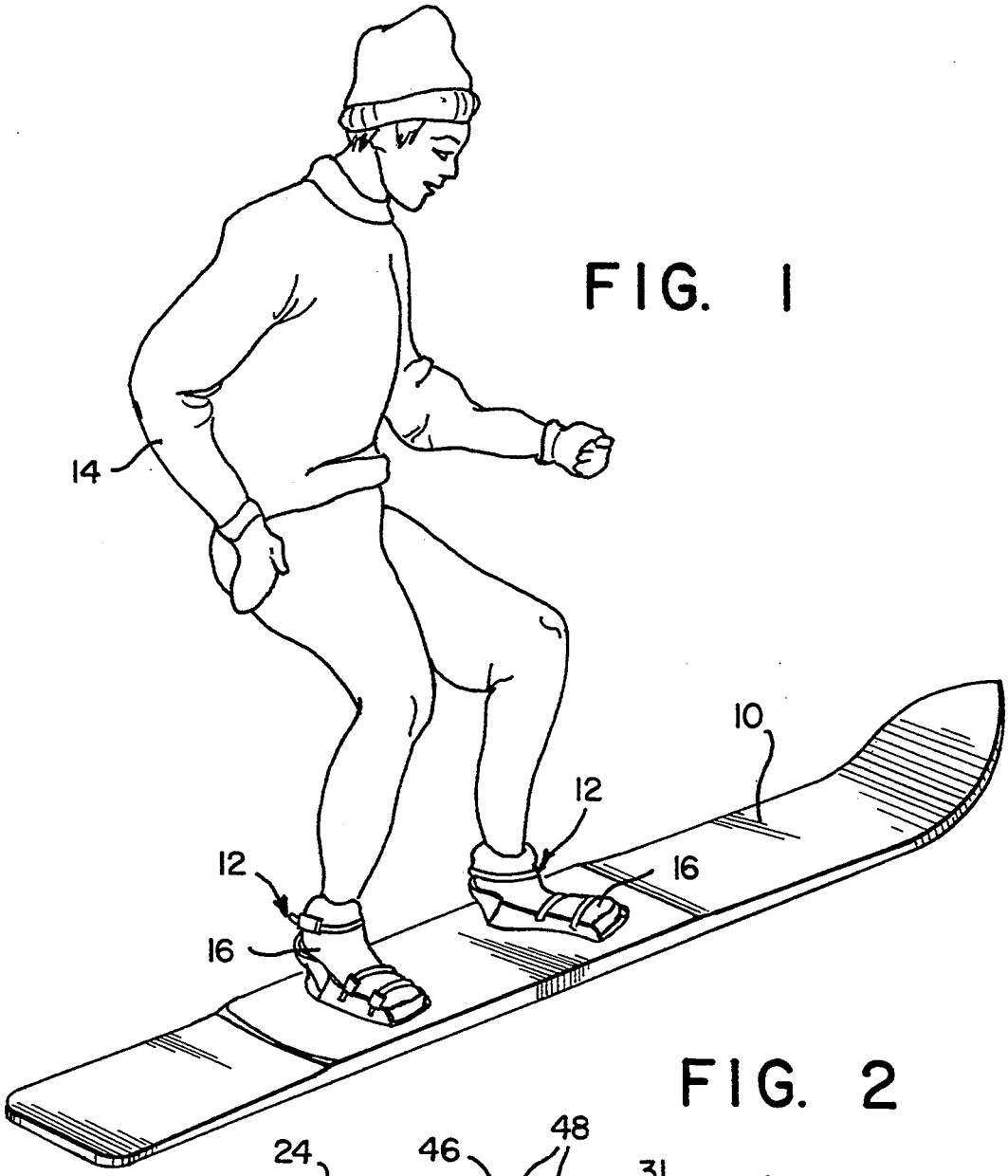
FIG. 1
FIG. 2
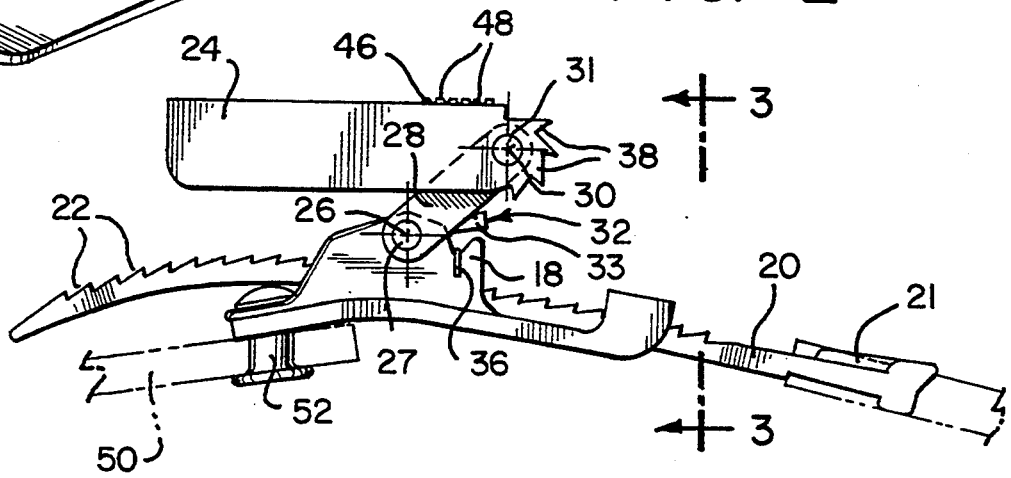

RATCHET-TYPE BUCKLE

FIELD OF THE INVENTION

The present invention relates generally to a ratchet-type buckle. More specifically, the present invention relates to a snowboard binding ratchet-type buckle having a pivoting lever that is used to engage and adjust the tension of a strap, which lever may also be used to release the strap from its locked position.

BACKGROUND OF THE INVENTION

A recently popular sport, snowboarding presents operating conditions and physical demands to boot buckles that are not dissimilar to other skiing-type sports. In snowboarding, the operator stands with both feet on the snowboard, somewhat similar to a Slalom-type water ski. Given the sophisticated structure of presently manufactured boots for ski-type sports and the operating conditions the boots are subject to, a reliable and tight connection between the foot and ankle of the rider and the boot is required. To accomplish this often requires a complex mechanism and considerable strength on the part of the user to operate the buckle mechanism properly.

Many of the foregoing problems have been resolved by the provision of a ratchet-type buckle. The ratchet-type buckle provides a large mechanical advantage to a user and permits incremental tightening of the boot in steps determined by the dimensions of the ratcheting teeth. Examples of these prior art types of ratcheting buckles are disclosed in U.S. Pat. No. 4,326,320 issued Apr. 27, 1982 to Riedel ("Riedel"), and U.S. Pat. No. 4,547,980 issued Oct. 22, 1985 to Olivieri ("Olivieri").

Notwithstanding the foregoing ratchet-type buckle arrangements, there are still major problems involved. The straps of the ratchet-type buckle are typically tightened by pivoting a lever about the axis of a pin. In addition to the lever arm, an additional element, such as a pawl, must be used to prevent the strap from being pulled back in the non-tensioning direction, i.e., to place the strap in a one-way locked position.

In ratchet-type buckles, it is necessary to include a release mechanism to release or unlock the pawl from the strap so that the strap can be pulled back in the non-tensioning direction. However, it is just as important to ensure that the ratchet-type buckle does not permit inadvertent release of the strap in the non-tensioning direction. In the latch-type mechanism disclosed by Riedel, the tensioning lever 2 can easily be inadvertently pivoted to a position as shown in FIG. 7, thus causing an accidental release of the rack 1. In the latch-type mechanism of Olivieri, the inadvertent depression of portion 8b of the pawl 8 will cause an accidental release of tie 18.

It is, therefore, an object of the present invention to provide a ratchet-type buckle that permits incremental ratcheting of the strap in a tensioning direction while simultaneously preventing inadvertent release of the strap from the one-way locked position. It is a further object to provide a lever which is a non-load bearing member when the strap is tightened.

It is an object of the present invention to provide a ratchet-type buckle that requires less parts and, thus, is smaller and easier to manufacture. It is still a further object of the present invention that the ratchet-type buckle arrangement be simple and cost effective to manufacture, yet reliable and efficient in use.

SUMMARY OF THE INVENTION

In accordance with a preferred embodiment demonstrating further objects, features and advantages of the invention, a ratchet-type buckling system includes a standard type buckle housing and a standard type strap having a rack of teeth on one surface. A pivotal spring-biased tab, functioning as a pawl, is part of a housing that slidingly receives the strap. The spring-biased tab pivots about a first axis to engage the teeth of the strap and prevent the strap from being unlocked or pulled back in the non-tensioning direction. A lever with teeth on one end is pivoted about a second axis to engage the teeth of the strap and feed the strap in the tensioning direction. The lever includes a downwardly depending projection that is movable between a first position and a second position. When the projection is in the first position, the downwardly depending projection does not come into contact with the spring-biased tab. However, when the projection is moved to the second position, and the lever arm is pivoted about the first axis, the projection engages with the spring-biased tab to move the tab's pawl away from the strap. The strap is now free to move in the non-tensioning direction.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein;

FIG. 1 is a perspective view of a rider on a snowboard having a ratchet-type buckle arrangement according to the present invention;

FIG. 2 is a side view of a ratchet-type buckle arrangement according to the present invention;

DETAILED DESCRIPTION OF THE PRESENTLY PREFERRED EXEMPLARY EMBODIMENTS

Figure 3:
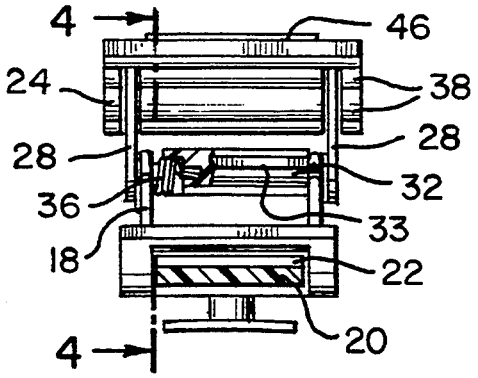
FIG. 3 is a sectional view taken along lines 3—3 of FIG. 2 and looking in the direction of the arrows.

Referring to FIG. 1, a snowboard 10 of conventional construction and a snowboard ratchet-type buckling arrangement 12, according to the present invention, with a rider 14 having his/her feet engaged in the system, is illustrated. The rider 14 is supported on the board 10 by securing his/her foot and ankle within a boot 16. The rider 14 can incrementally tighten the strap of the boot by ratcheting a lever arm of the ratchet-type buckle arrangement.

Referring now to FIG. 2, the ratchet-type buckle arrangement includes a housing 18 and a strap 20 that is slidably received in the housing 18. The strap 20 includes a rack of teeth 22 disposed at a first end of the strap 20 on an upper surface of the strap 20; it being understood that relative orientation adjectives such as "upper", "downwardly", etc. are utilized herein to simplify the present description and are not intended to limit the orientation of the buckle assembly when mounted for use. The strap includes a shoulder 21 adjacent to the rack of teeth 22.

A lever arm 24 is connected to the housing 18 by a pair of links or connecting arms 28. The connecting arms 28 are pivotally connected to the housing 18 by a pin 27 about a first axis 26. The lever arm 24 is pivotally connected to the connecting arms 28 by a pin 31 about a second axis 30. Accordingly, the lever arm 24 is pivotally mounted to the housing 18 about both the first axis 26 and the second axis 30. As illustrated, the second axis 30 is spaced from the first axis 26.

Figure 4:
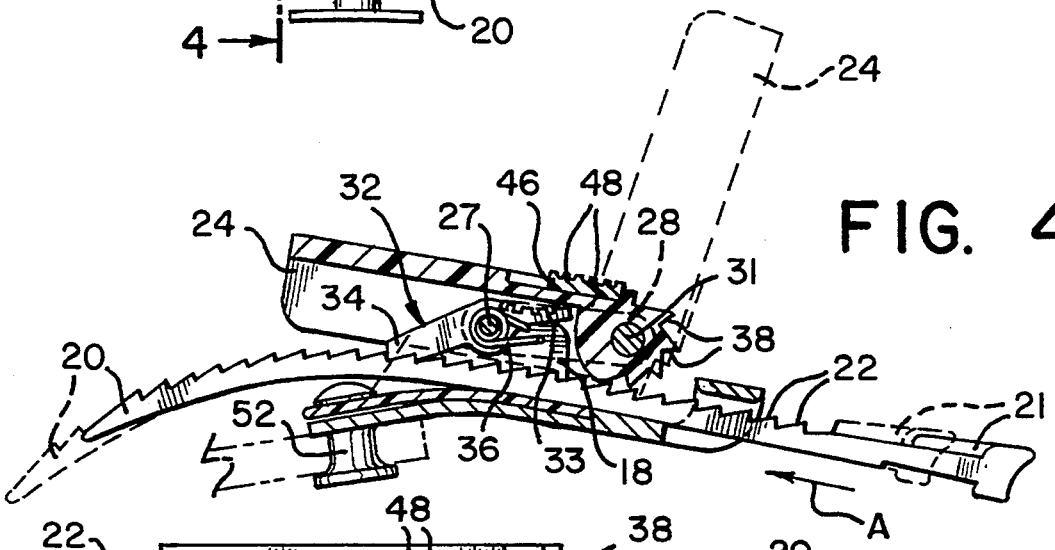
FIG. 4 is a sectional view taken along lines 4—4 of FIG. 3 and looking in the direction of the arrows.

A tab 32 (see FIGS. 4 and 6) is pivotally mounted to the housing 18 by pin 27 about the first axis 26 and is disposed between the two connecting arms 28. Tab 32 includes a pawl portion 34 at a first end thereof. Additionally, the tab 32 includes a second end 33 disposed opposite to the pawl portion 34. The tab 32 is biased by a spring 36 such that the pawl 34 is in engagement with the rack of teeth 22 disposed on the upper surface of the strap 20. The spring biased pawl 34 allows the strap 20 to incrementally ratchet in a tensioning or first direction, generally indicated by arrow A in FIG. 4, and prevents the movement of the strap 20 in the direction substantially opposite to the tensioning direction, generally indicated by arrow B in FIG. 6.

Figure 5:
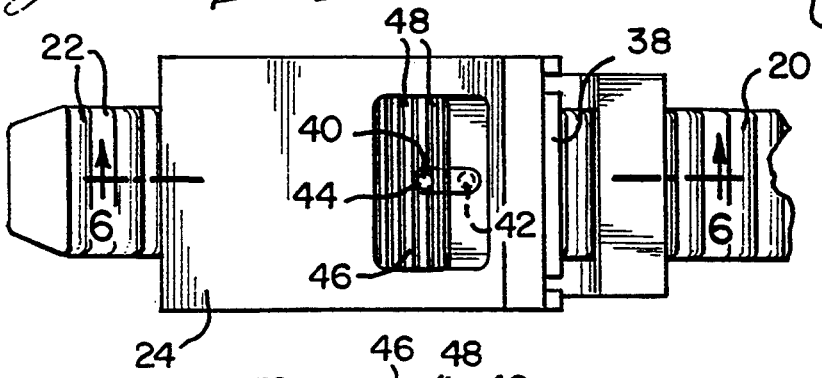
FIG. 5 is a top view of a ratchet-type buckle arrangement according to the present invention.
Figure 6:
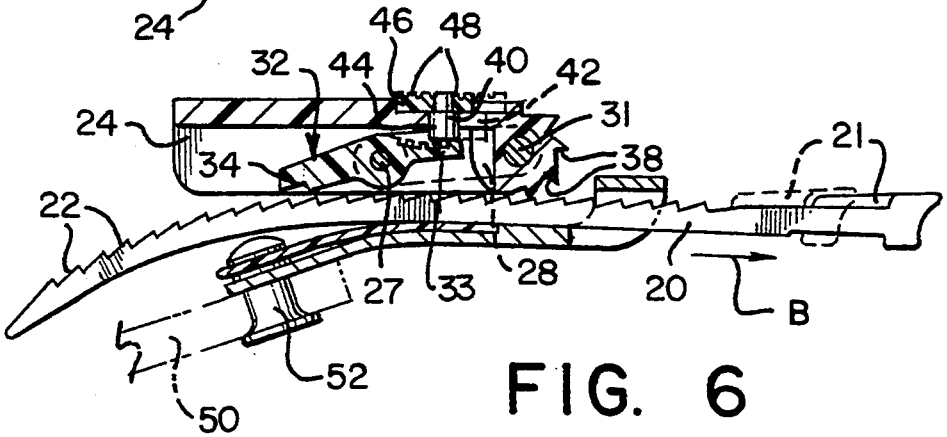
FIG. 6 is a cross-sectional view taken along lines 6—6 of FIG. 5 and looking in the direction of the arrows.

The lever arm 24 includes saw teeth 38 disposed at a first end of the lever arm 24. The saw teeth are disposed about the second axis 30 substantially along a common radius from the second axis 30. The lever arm 24 further includes a downwardly depending projection 40 as best seen in FIGS. 5 and 6. The projection 40 is longitudinally moveable, with respect to the lever arm 24, between a first position, generally indicated at 42, and a second position, generally indicated at 44. A plate member 46 is integrally attached to the projection 40 and is disposed on an upper surface of the lever arm 24. The plate 46 may include a plurality of ribbed projections 48 on its upper surface to allow the operator to more easily adjust the position of the projection 40 between the first position 42 and the second position 44.

The housing 18 is preferably attached to the boot 16 and may additionally be attached to the second end 50 of the strap 20. The housing includes a downwardly depending projection 52 in the form of a rivet to allow the housing to be fixedly connected to the second end 50 of the strap 20. Of course, the housing 18 may be attached to the boot 16 in any manner known to those skilled in the art.

The operation of the ratchet-type buckle arrangement will be described below with reference to FIGS. 2–6. The strap 20 is placed within the housing 18 as shown in FIG. 2. At this time, the downwardly depending projection 40 should be moved to be in the first position 42. Typically, the strap 20 is fitted loosely within the housing 18 and must be tightened by the user so that the foot and ankle will be adequately supported within the boot. To accomplish this, the user pivots the lever 24 about its first axis 26 until the lever reaches the position shown in solid lines in FIG. 4. The user will then pivot the lever arm 24 about the second axis 30 to a position shown in phantom in FIG. 4. This pivoting movement causes the saw teeth 38 to engage with the rack teeth 22 of the strap and, thus, incrementally ratchet tightens the strap 20 in the direction indicated by arrow A in FIG. 4. As the lever arm 24 is rotated about the second axis 30 to tighten the strap 20, the pawl portion 34 of the tab 32 is continuously spring biased in constant engagement with the rack teeth 22 of the strap 20 to prevent the strap from being inadvertently released during the ratcheting operation. In this manner, the rider can adjust the strap to a desired tension by pivoting the lever arm 24 about the second axis 30 as many times as are required. It being understood that shoulder 21 on the strap 20 serves as a stop to prevent the strap from being tightened beyond a predetermined limit.

To unfasten the boot, the pawl 34 must be released from the strap 20. First, the position of the downwardly depending projection 40 must be moved from the first position 42 to the second position 44, as shown in FIGS. 5 and 6. The user can simply achieve this by adjusting the position of the plate 46 on top of the lever arm 24. Once the projection 40 is in the second position 44, the user can then pivot the lever arm 24 about the first axis 26. The downwardly depending projection 40 will come into contact with the second end 33 of the tab 32. Continuous rotation of the lever 24 about the first axis 26 will cause the pawl portion 34 of tab 32 to disengage from the rack teeth 22 (see FIG. 6). The strap 20 is now free to move in either direction indicated by arrows A or B, and the rider can simply pull on the strap in the direction of arrow B, if necessary, to loosen the strap.

It will be appreciated that the ratchet-type buckle of the present invention successfully prevents the strap 20 from being inadvertently released from the one-way locked position. To release the strap 20 requires the occurrence of two distinct operations. First, the projection 40 must be moved from the first position 42 to the second position 44. Second, the lever arm 24 must be rotated sufficiently to cause the pawl 34 to disengage from the rack teeth 22. The chances of both of these operations unintentionally occurring simultaneously are extremely low.

Figure 7:
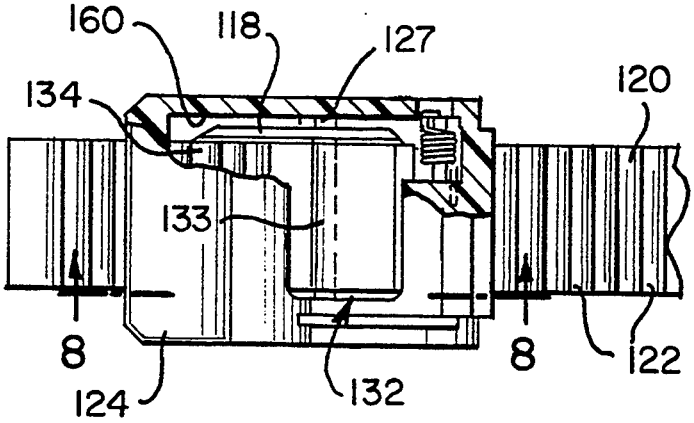
FIG. 7 Is a top view partially broken away of another embodiment of a ratchet-type buckle arrangement according to the present invention.
Figure 8:
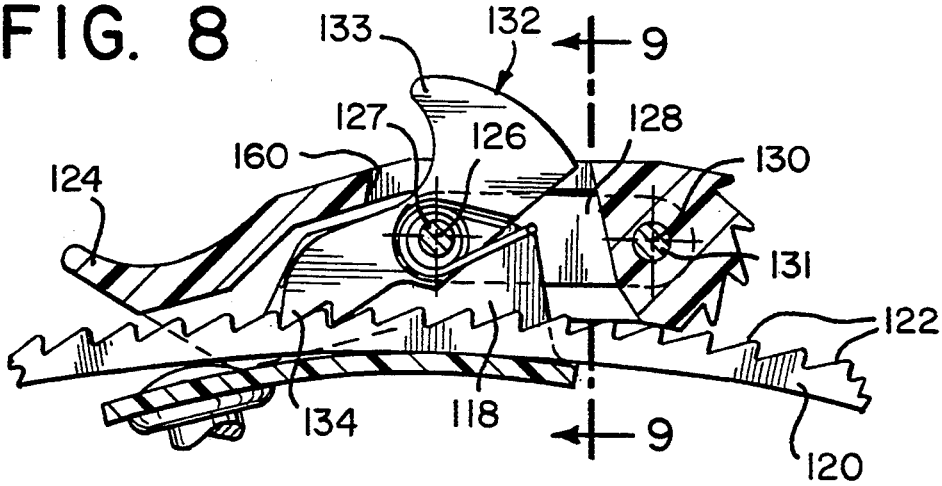
FIG. 8 is a sectional view taken along lines 8—8 of FIG. 7 and looking the direction of the arrows.
Figure 9:
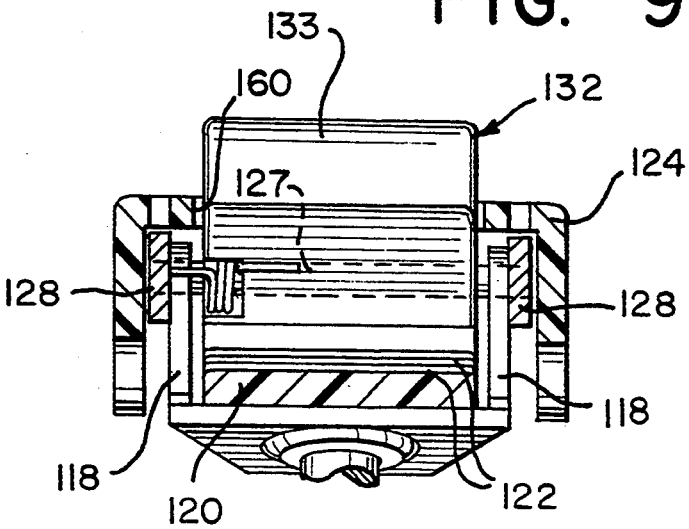
FIG. 9 is a section view taken along lines 9—9 of FIG. 8 and looking in the direction of the arrows.

Another embodiment of the present invention is shown in FIGS. 7–9. Many of the components in this embodiment are similar to those illustrated in FIGS. 1–6. Therefore, like reference numerals, in the 100 series, will be designated to indicate these like components. For the sake of brevity, those components which are structurally and functionally similar to the first embodiment will not be described further.

A lever arm 124 is connected to the housing 118 by a pair of links or connecting arms 128. The connecting arms 128 are pivotally connected to the housing 118 by a pin 127 about a first axis 126. The lever arm 124 is pivotally connected to the connecting arms 128 by a pin 131 about a second axis 130. Accordingly, the lever arm 124 is pivotally mounted to the housing 118 about both the first axis 126 and the second axis 130. As illustrated, the second axis 130 is spaced from the first axis 126.

The lever 124 has a window opening 160 through which the second end 133 of the tab 132 projects. The tab 132 includes a pawl portion 134 at a first end thereof. The tab 132 is spring biased in a similar manner as tab 32 such that pawl 134 functions as does pawl 34. Accordingly, the pawl 134 allows the strap 120 to incrementally ratchet in a tensioning direction and prevents the movement of the strap 120 in the direction opposite too the tensioning direction.

To operate the ratchet-type buckle arrangement of this second embodiment, the strap 120 is placed within the housing 118 as shown in FIG. 8. To tighten the strap 120, the user pivots the lever 124 about its first axis 126 until the lever reaches a position similar to that shown in solid lines in FIG. 4. The strap 120 is then tightened in a similar manner to the tightening of strap 20.

To unfasten the boot, the user can simply depress the second end 133 of the tab 132 which is protruding through the window opening of lever 124. This action will cause the tab 132 to pivot, in a clockwise direction as viewed in FIG. 8, and cause the pawl portion 134 to disengage from the teeth 122 of the strap 120. The strap 120 is now free to move in either direction A or B.

From the foregoing description, it will be appreciated that the present invention makes available, a compact, cost efficient ratchet-type bracket arrangement. The ratchet-type bracket is designed to allow for simple operation while preventing an inadvertent release of the strap from the one-way locked position. Additionally, the lever is designed to be a non-load bearing member when the strap is tightened. Thus, when in use, the lever will not put pressure on the base of the housing which could cause discomfort to the foot of the user.

Having described the presently preferred exemplary embodiment of a new and improved ratchet-type bracket arrangement in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A ratchet-type buckle comprising:

(a) a housing;

(b) a strap, having a rack of teeth on at least a portion of one surface, being slidably received within said housing;

(c) a tab pivotally mounted to said housing about a first axis in a position to engage said strap during pivoting;

(d) means for biasing said tab into engagement with said rack of teeth on said strap, said tab and teeth being constructed so that when said tab engages a tooth, said strap can move in a first direction relative to said tab but is prevented from moving in a second direction which is substantially opposite to said first direction; and (e) a lever arm pivotally mounted to said housing about said first axis and about a second axis which is spaced from said first axis.

2. The ratchet-type buckle as in claim 1, wherein said lever arm comprises a first end and a second end, saw teeth being disposed at said first end, adjacent to said second axis in a position to engage said rack of teeth on said strap when said lever arm is pivoted about said second axis, to feed said strap in said first direction.

3. The ratchet-type buckle as in claim 2, wherein said saw teeth are disposed about said second axis.

4. The ratchet-type buckle as in claim 2, wherein said lever arm further comprises a downwardly depending projection that is movable, with respect to said lever arm, between a first position and a second position, said projection being remote from said tab in said first position and being in contact with said tab in said second position when said lever arm is in a predetermined pivotal orientation.

5. The ratchet-type buckle as in claim 3, wherein when said projection is in said second position and said lever arm is pivoted to said predetermined orientation, the contact between said projection and said tab causes said tab to disengage from said rack of teeth.

6. The ratchet-type buckle as in claim 5, wherein said lever arm includes a plate slidably disposed on an upper surface, opposite said projection, said plate being fixedly connected to said projection.

7. The ratchet-type buckle as in claim 1, wherein said biasing means comprises a spring.

8. The ratchet-type buckle as in claim 1, wherein said strap having an end disposed opposite to said rack of teeth, said strap end being fixedly attached to said housing.

9. The ratchet-type buckle as in claim 1, wherein said tab includes a first end and a second end, said tab engages said tooth at said first end, said lever arm includes a window opening through which said second end of said tab projects.

10. The ratchet-type buckle as in claim 9, wherein when said tab is pivoted about the first axis in a direction opposite to said biasing means, said tab disengages from said tooth.

11. A ratchet-type buckle comprising:

(a) a strap having a rack of teeth on at least a portion of one surface;

(b) a housing having means for slidably receiving said strap;

(c) a tab pivotally mounted to said housing about a first axis in a position to engage said strap during pivoting;

(d) means for biasing said tab into engagement with said rack of teeth on said strap, said tab and teeth being constructed so that when said tab engages a tooth, said strap can move in a first direction relative to said tab but is prevented from moving in a second direction which is substantially opposite to said first direction;

(e) a pair of connecting arms being pivotally mounted to said housing by a pin about said first axis; and (f) a lever arm pivotally mounted to said pair of connecting arms by a second pin about a second axis such that said lever arm is pivotally mounted to said housing about said first axis and about said second axis which is spaced from said first axis.

12. The ratchet-type buckle as in claim 11, wherein said lever arm comprises a first end and a second end, saw teeth being disposed at said first end, adjacent to said second axis in a position to engage said rack of teeth on said strap when said lever arm is pivoted about said second axis, to feed said strap in said first direction.

13. The ratchet-type buckle as in claim 12, wherein said saw teeth are disposed about said second axis.

14. The ratchet-type buckle as in claim 12, wherein said lever arm further comprises a downwardly depending projection that is movable, with respect to said lever arm, between a first position and a second position, said projection being remote from said tab in said first position and being in contact with said tab in said second position when said lever arm is in a predetermined pivotal orientation.

15. The ratchet-type buckle as in claim 14, wherein when said projection is in said second position and said lever arm is pivoted to said predetermined orientation, the contact between said projection and said tab causes said tab to disengage from said rack of teeth.

16. The ratchet-type buckle as in claim 15, wherein said lever arm includes a plate slidably disposed on an upper surface, opposite said projection, said plate being fixedly connected to said projection.

17. The ratchet-type buckle as in claim 11, wherein said biasing means comprises a spring.

18. The ratchet-type buckle as in claim 11, wherein said strap having an end disposed opposite to said rack of teeth, said strap end being fixedly attached to said housing.

19. The ratchet-type buckle as in claim 11, wherein said tab includes a first end and a second end, said tab engages said tooth at said first end, said lever arm includes a window opening through which said second end of said tab projects.

20. The ratchet-type buckle as in claim 19, wherein when said tab is pivoted about the first axis in a direction opposite to said biasing means, said tab disengages from said tooth.

* * * * *